US007399019B2

(12) United States Patent
Malmgren et al.

(10) Patent No.: US 7,399,019 B2
(45) Date of Patent: Jul. 15, 2008

(54) AUTOMATIC ADJUSTABLE SPREADER BAR

(75) Inventors: Brian J. Malmgren, Shorewood, IL (US); Daniel Brian Zakula, Sr., Mokena, IL (US); Myron Glickman, Arlington Heights, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 0 days.

(21) Appl. No.: 11/431,491

(22) Filed: May 9, 2006

(65) Prior Publication Data

US 2007/0262599 A1 Nov. 15, 2007

(51) Int. Cl.
*B66C 1/28* (2006.01)

(52) U.S. Cl. ..... 294/81.51; 294/81.2; 294/81.53; 294/81.56

(58) Field of Classification Search ..... 294/81.1, 294/81.2, 81.21, 81.3, 81.51, 81.52, 81.53, 294/81.5, 81.56, 81.61
See application file for complete search history.

(56) References Cited

U.S. PATENT DOCUMENTS 1,882,704 A * 10/1932 Andersen et al. ..... 294/81.51
1,928,213 A * 9/1933 Showers, Jr. et al. ..... 294/81.2
3,558,176 A * 1/1971 Fathauer et al. ..... 294/81.21
3,596,970 A * 8/1971 Levert et al. ..... 294/81.2
3,770,309 A * 11/1973 Merchant et al. ..... 294/81.21
4,149,747 A * 4/1979 Portz et al. ..... 294/81.21
4,215,892 A * 8/1980 Holmes ..... 294/81.21
4,488,749 A * 12/1984 Voelz ..... 294/81.21
5,370,435 A * 12/1994 Monk et al. ..... 294/81.54
5,560,663 A * 10/1996 Hara et al. ..... 294/81.41
6,129,396 A * 10/2000 Asada et al. ..... 294/86.41

* cited by examiner

*Primary Examiner*—Dean J Kramer
(74) *Attorney, Agent, or Firm*—Drinker Biddle & Reath LLP

(57) ABSTRACT

A device for lifting oversized pieces of material. The device includes a spreader bar capable of attaching to a lifting vehicle. At least two cross members are attached to the spreader bar along with at least one cross-member power source. The at least one cross-member power source is connected to at least one drive mechanism which in turn is connected to at least one of the at least two cross members. A load-pick power source is attached to each of the at least two cross members and well as to at least one load-pick drive mechanism. The at least one load-pick drive mechanism is connected to each of the at least two load pick points, and the cross-member and the load-pick power sources are each electrically connected to an operating or control panel in a cab of the lifting vehicle.

13 Claims, 13 Drawing Sheets

AUTOMATIC ADJUSTABLE SPREADER BAR

FIELD OF THE INVENTION

This invention pertains to a device for lifting large objects such as I-beams and precast slabs of concrete.

BACKGROUND OF THE INVENTION

Precast and prestressed concrete products come in many forms. These products include precast rooms such as jail cells and road and building products such as I-beams, double tees, and bridge segments.

In the normal course of a manufacturing or construction process, these precast and prestressed products must be moved several times. At a minimum, the products are moved from the mold to storage area for curing and then from storage to a transportation vehicle for shipping.

These precast and prestressed products usually have a lifting means integrally placed on them. These lifting means can be wire rope loops, inserts for attaching lifting devices, or other lifting means. The actual lifting and moving of the product is typically accomplished by the use of some type of lifting vehicle such as a gantry crane or boom crane.

The products to be lifted usually have multiple lift points and the lifting vehicle often uses a spreader bar with multiple lift points to connect to the product to be lifted. The spreader bar also has crane lift points that are used to connect the spreader bar to the lifting vehicle.

The actual connection of the product to be lifted to the spreader bar is accomplished with a variety of devices such as slings, hooks, shackles, specialized attaching devices, etc. The connections are typically made by yard personnel manually connecting the spreader lifting devices to the pick points on the product. This process often involves manually positioning variable position lifting points on the spreader. This manual process is time consuming and sometimes hazardous when yard personnel must climb on stacks of stored products to make the connections. Given these problems, an automatic and remotely controlled device that alleviates and eliminates the steps and problems previously mentioned would be an important improvement in the art.

BRIEF SUMMARY OF THE INVENTION

The invention involves a device or system for lifting oversized pieces of material. The system is comprised of a spreader bar capable of attaching to a lifting vehicle. At least two cross members are attached to the spreader bar along with at least one cross-member power source. The at least one cross-member power source is connected to at least one drive mechanism which in turn is connected to at least one of the at least two cross members. A load-pick power source is attached to each of the at least two cross members as well as to at least one load-pick drive mechanism. The at least one load-pick drive mechanism is connected to each of the at least two load pick points. The cross-member and the load-pick power sources are each electrically connected to an operating or control panel in a cab of the lifting vehicle.

DETAILED DESCRIPTION OF THE INVENTION

Figure 1:
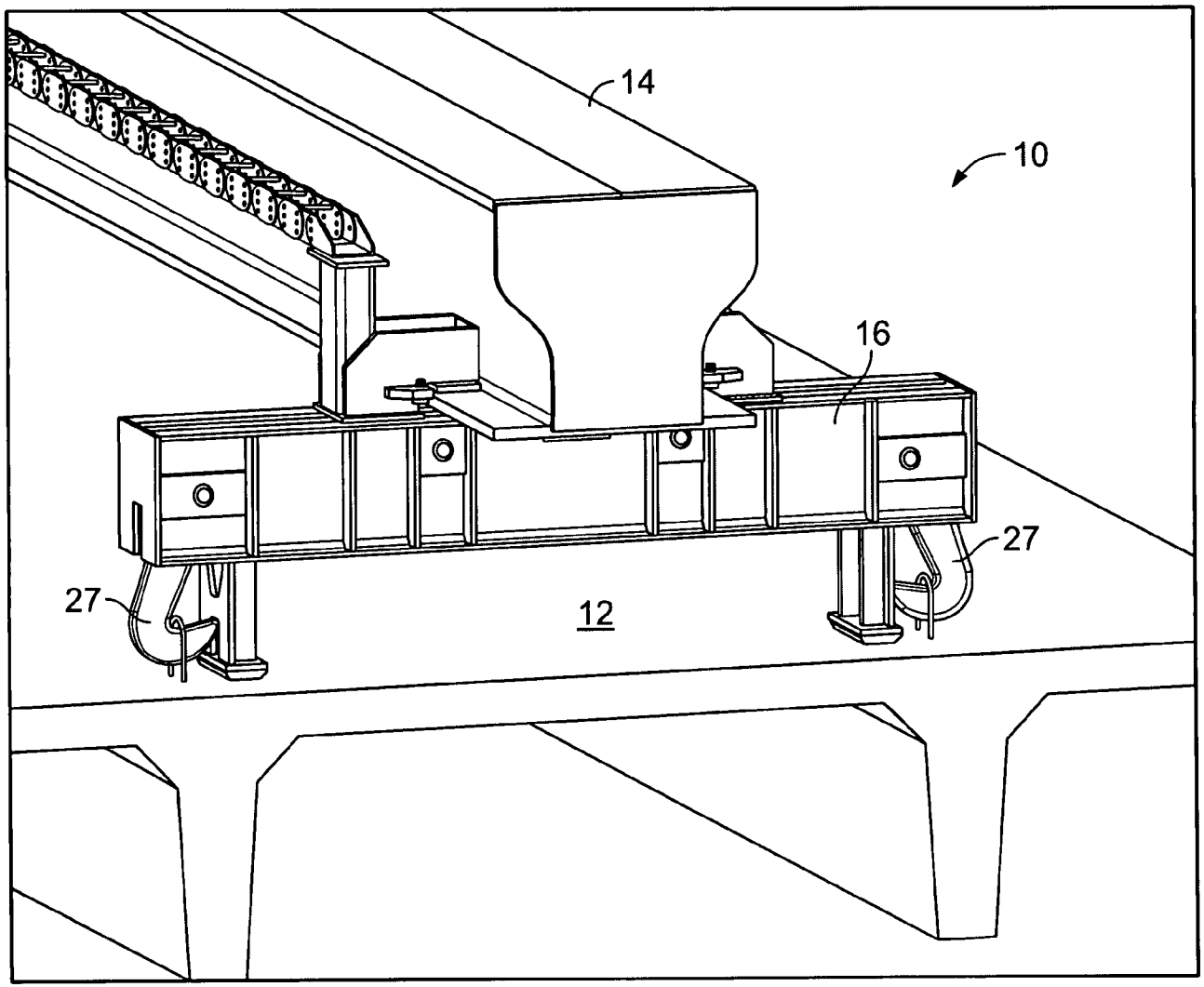
FIG. 1 is a perspective view of a portion of the inventive device showing a spreader bar with a cross member attached thereto and a pair of load pick points connected to the cross member with each load pick point engaging a connection point on an object to be lifted.
Figure 2:
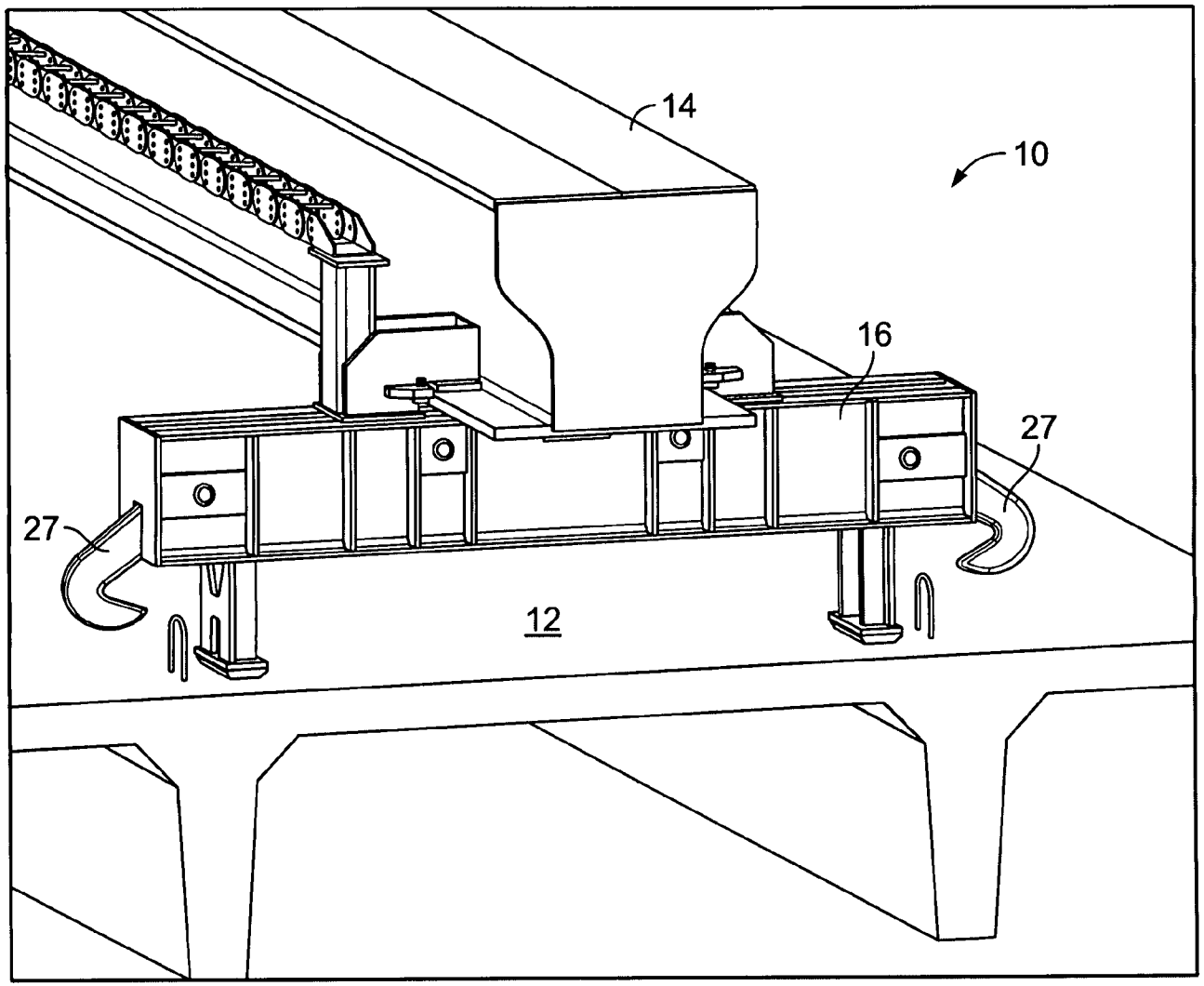
FIG. 2 is a perspective view of a portion of the inventive device showing a spreader bar with a cross member attached thereto and a pair of load pick points connected to the cross member with each load pick point disengaged from a connection point on an object to be lifted.
Figure 3:
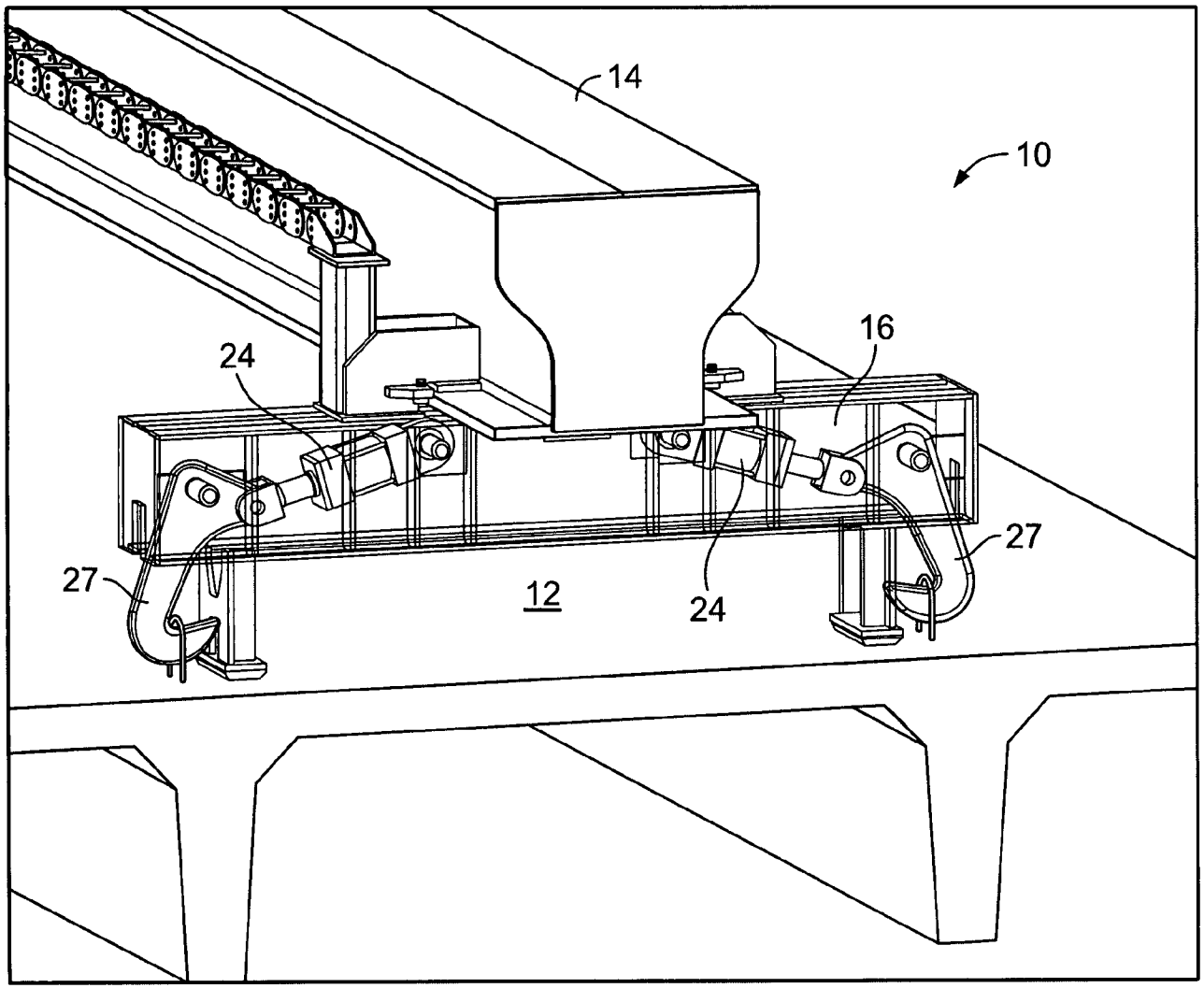
FIG. 3 is a cut-away view of a cross member showing each of the load pick points connected to an actuator.

The invention is directed to a device 10 for lifting oversized pieces of material 12. As shown in FIGS. 1-3, 5A, and 8, the device 10 is comprised of a spreader bar 14 capable of attaching to a lifting vehicle (not shown). At least two cross members 16 are attached to the spreader bar 14 which is also connected to at least one cross-member power source 18. The at least one cross-member power source 18 is connected to at least one drive mechanism 20 which in turn, is connected to at least one of the at least two cross members 16. A load-pick power source 22 is attached to each of the at least two cross members 16. The load-pick power source 22 is connected to at least one load-pick drive mechanism 25 which is also connected to each of the at least two load pick points 27. The cross-member power source 18 and the load-pick power sources 22 are each electrically connected to an operating panel in a cab of the lifting vehicle.

Figure 4:
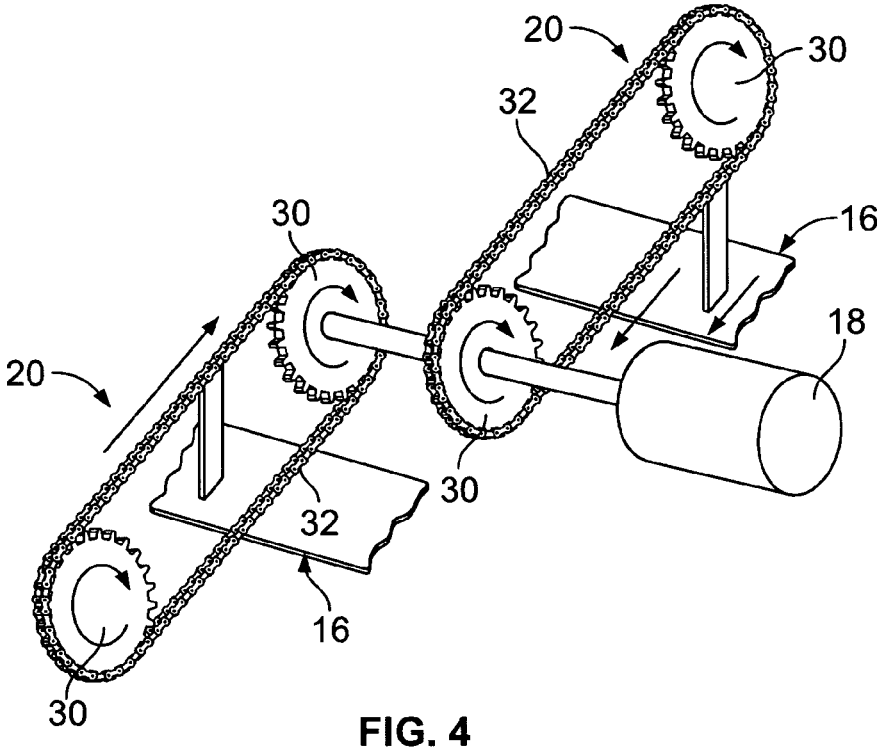
FIG. 4 is a schematic showing a cross-member power source used in the invention connected to two drive mechanisms that are connected to respective cross members.
Figure 5:
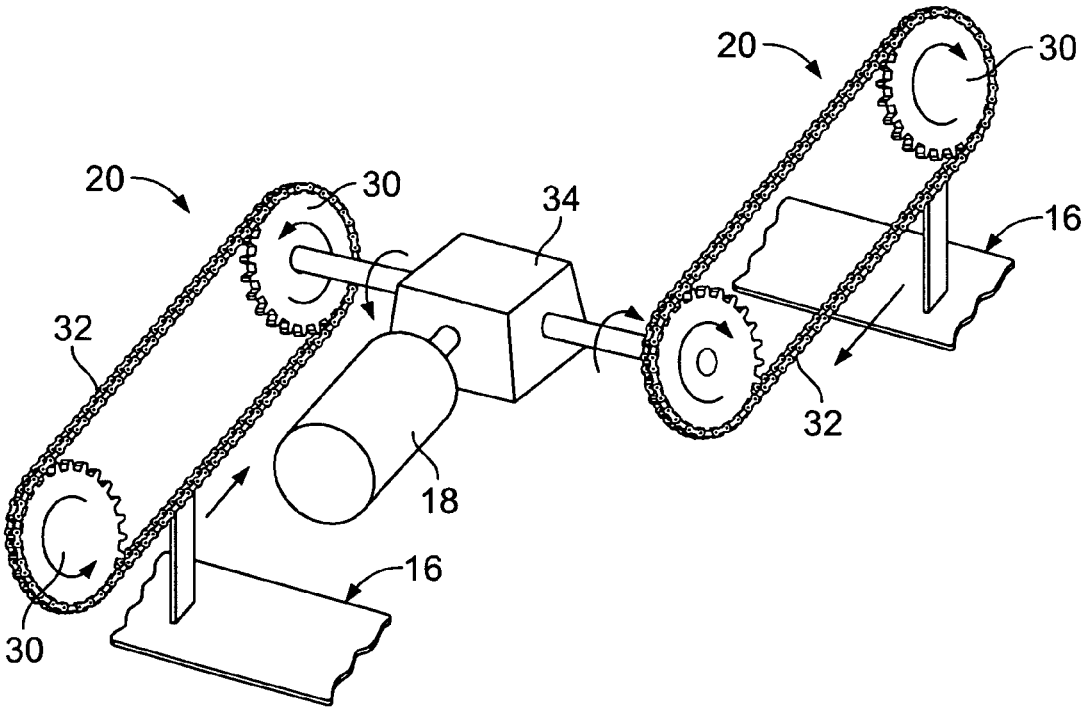
FIG. 5 is a schematic showing another embodiment of a cross-member power source used in the invention connected to two drive mechanisms that are connected to respective cross members.

In an embodiment of the invention, the cross-member power source 18 and the load-pick power source 22 are electric motors. These power sources 18, 22 may also be hydraulic motors or any other type of power source known in the art. The drive mechanism 20 can be a chain 32, as shown in FIGS. 4 and 5, however, any suitable drive mechanism known in the art including, but not limited to, a drive belt or hydraulic cylinder may be used without departing from the scope and spirit of the invention. In an embodiment, the cross-member power source 18 and load-pick power source 22 are each electrically connected to an operating panel remote from the lifting device. This embodiment allows an operator in the lifting vehicle cab or standing on the ground outside of the lifting vehicle to operate the cross members 16 and load-pick points 27 so as to correctly position them with respect to the material 12 to be lifted.

Figure 9A:
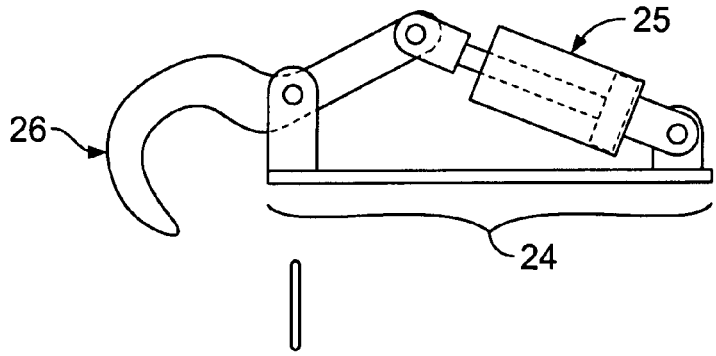
FIG. 9A shows a self-locking hook device disengaged from a loop-type lifting means on a product.
Figure 9B:
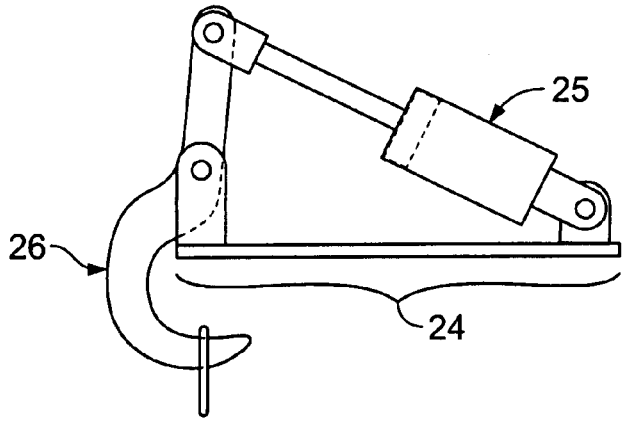
FIG. 9B shows a self-locking hook device engaged with a loop-type lifting means on a product.
Figure 10:
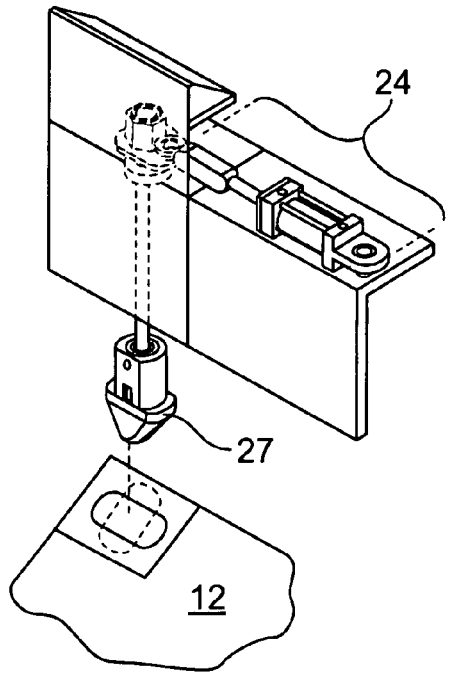
FIG. 10 shows a twist-lock type of device for engaging an insert in the product to be lifted.
Figure 11:
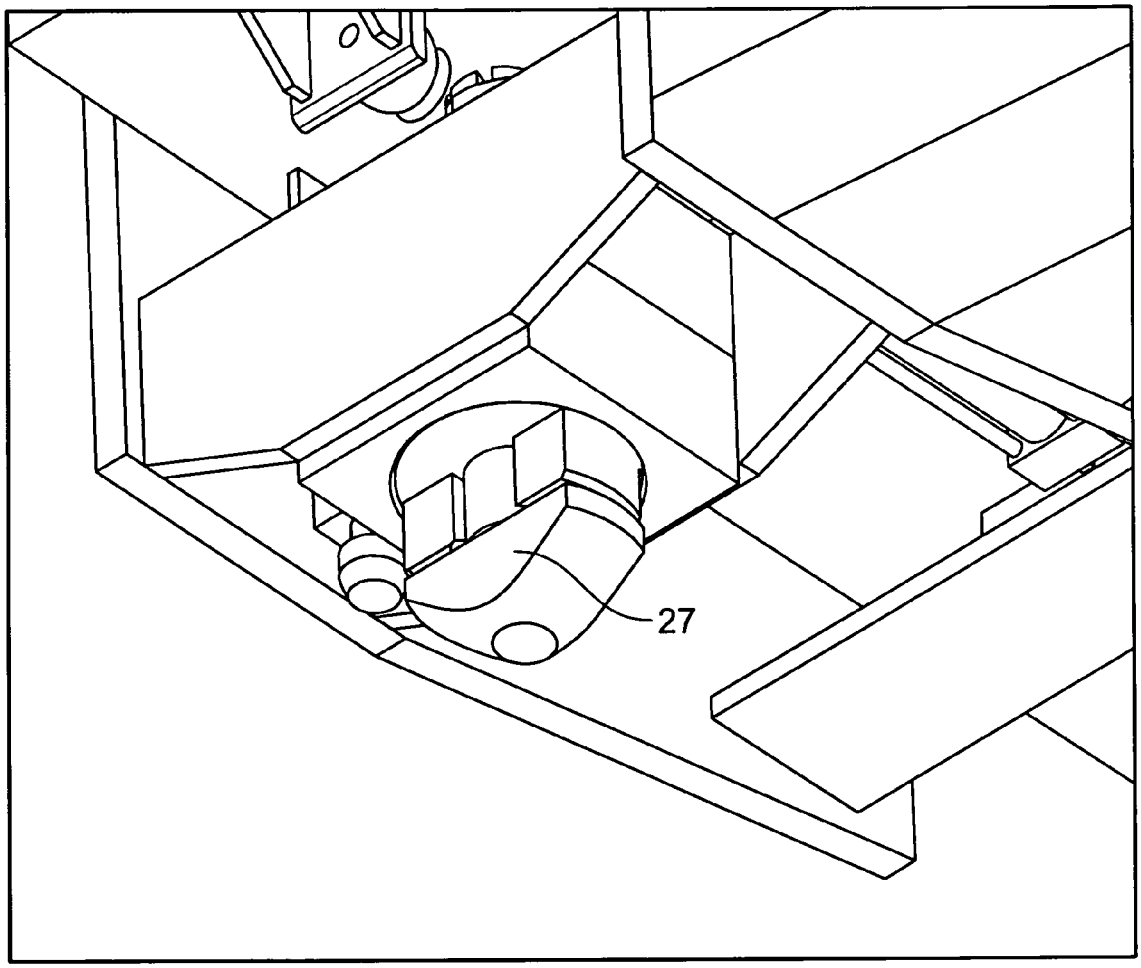
FIG. 11 shows a twist-lock type device in the retracted position within a cross member.
Figure 12:
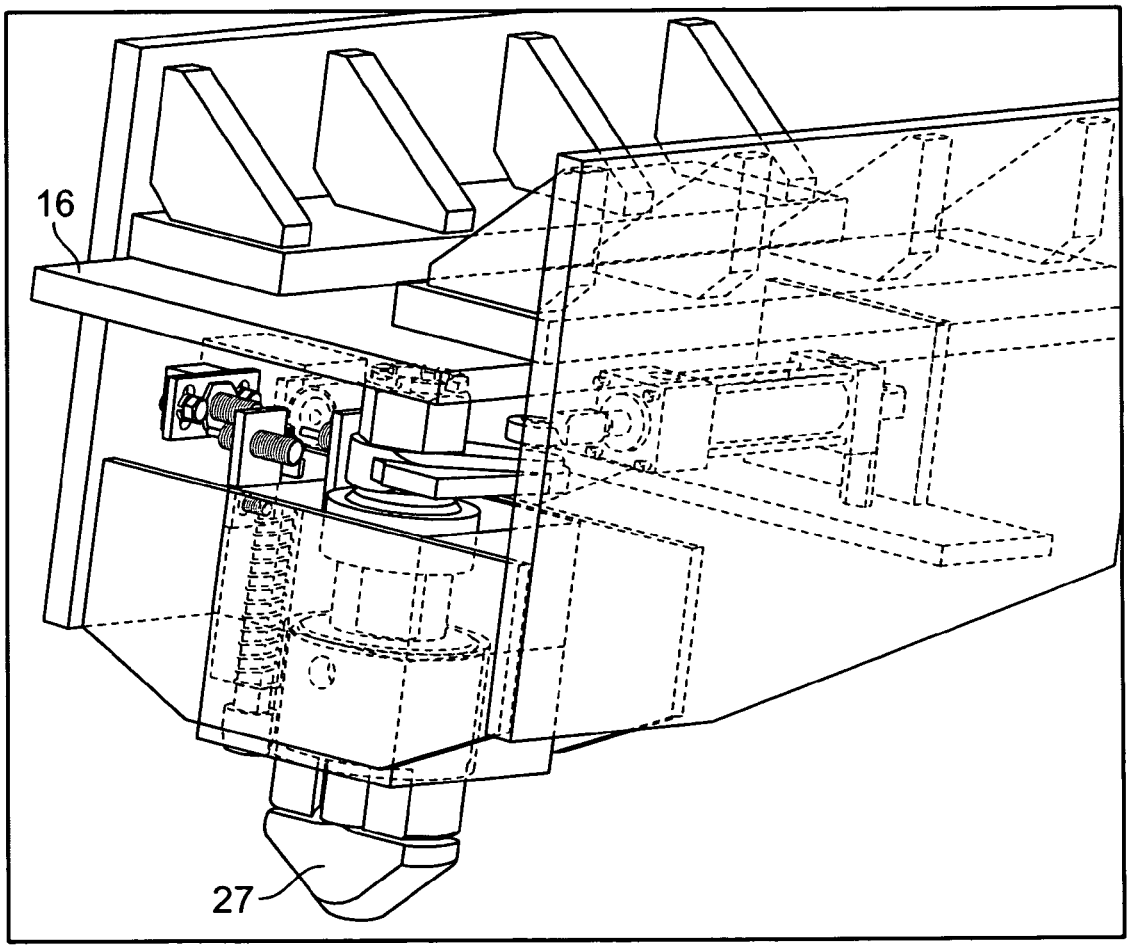
FIG. 12 is a cut-away view of a twist-lock type device retracted within a cross member.

The load pick points 27 can be a self-locking hook device 26, as shown in FIGS. 1-3, 9(*a*) and (*b*), or a twist-lock type device, as shown in FIGS. 10-12.

In an embodiment of the invention, the cross-member power source 18 is connected to a first and a second drive mechanism 20 and each of the first and second drive mechanisms 20 are connected to a first and a second cross-member 16, respectively. First and second load-pick power sources 22 are also connected to the respective first and second cross-members 16. These load-pick power sources 22 are also connected to their respective load-pick latching mechanisms 24 which are also connected to a first and second load pick point 27, respectively.

Figure 7:
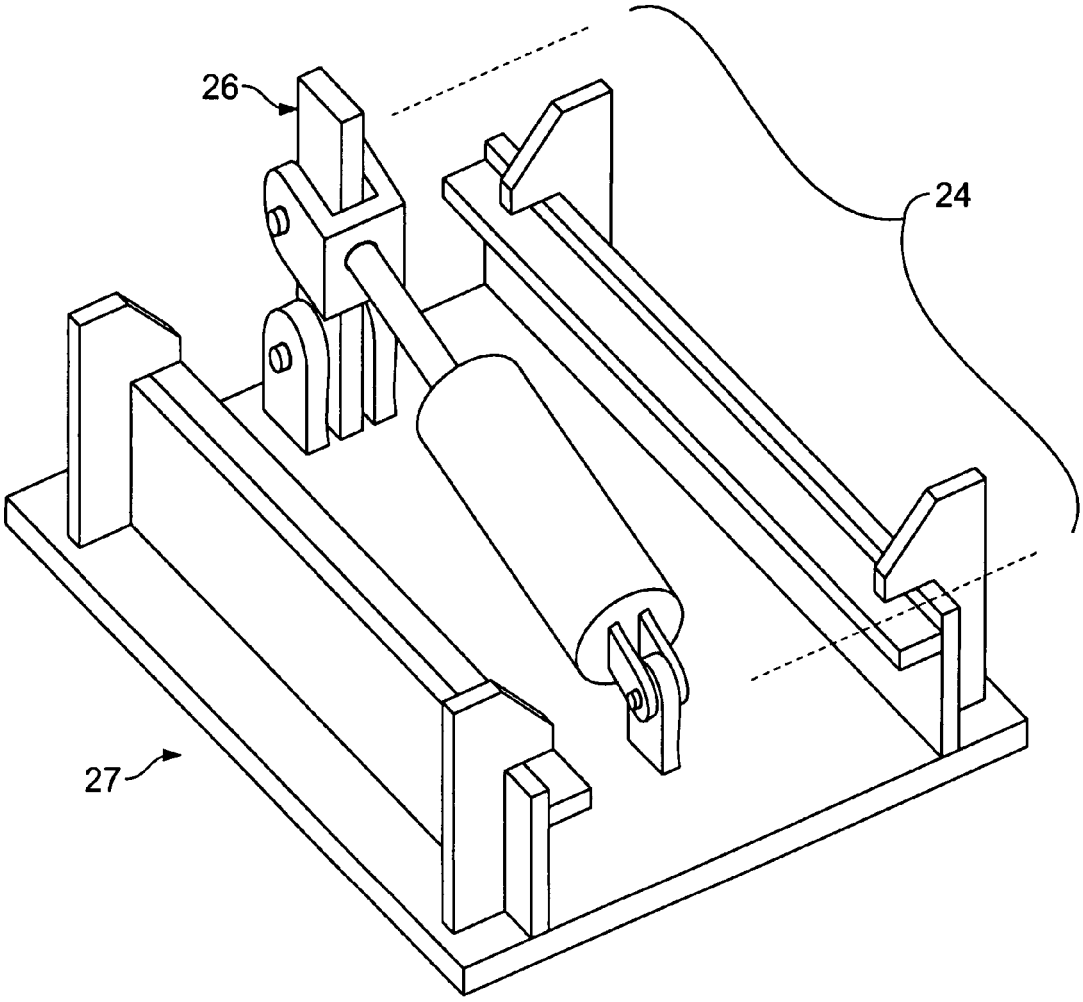
FIG. 7 is a perspective view of a sliding pick point assembly.
Figures 8, 8A:
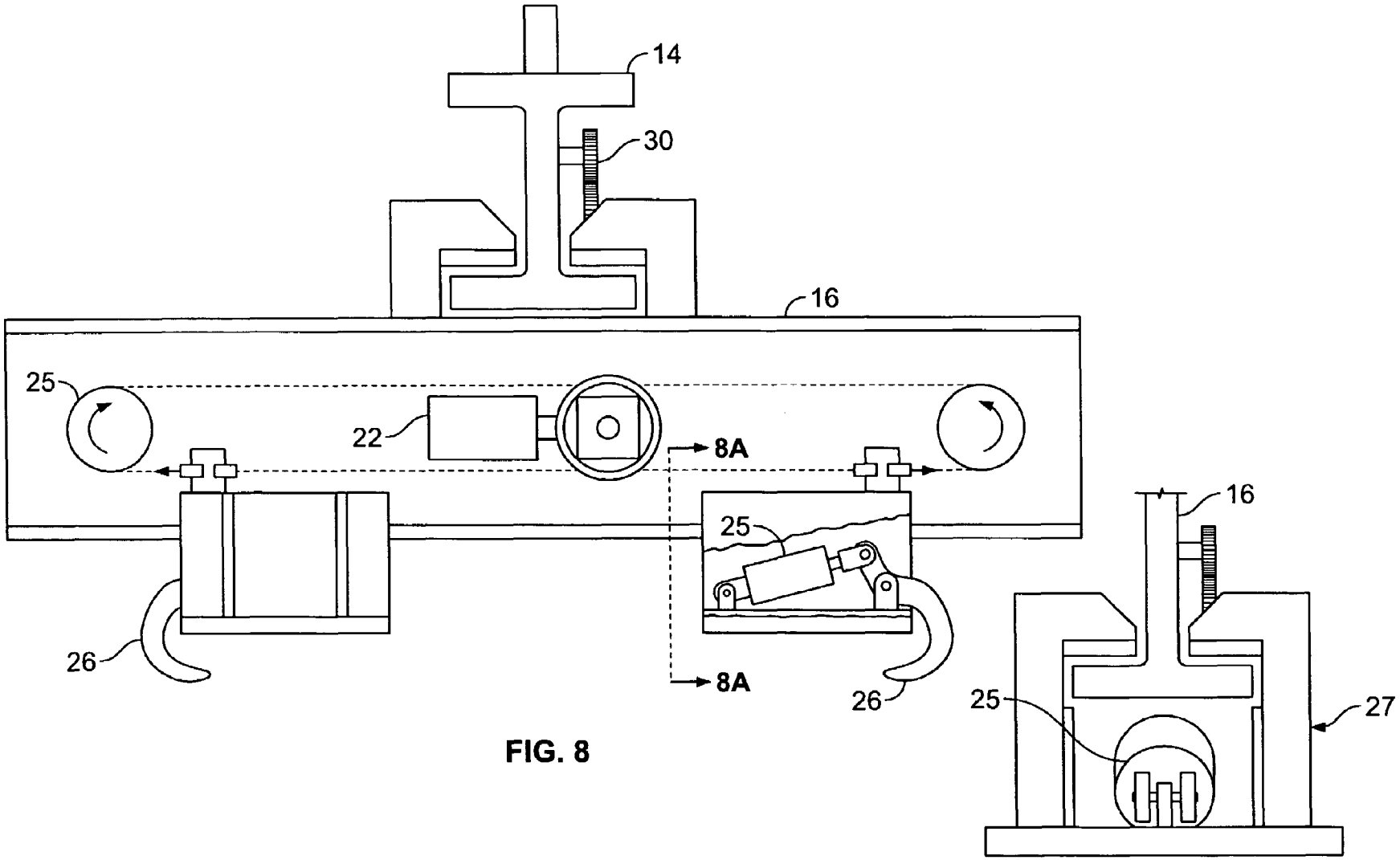
FIG. 8 is a view showing a cross member power source positioned on a cross member for positioning pick point assemblies along the cross member.
FIG. 8A is an end view of a load pick point.
Figure 14:
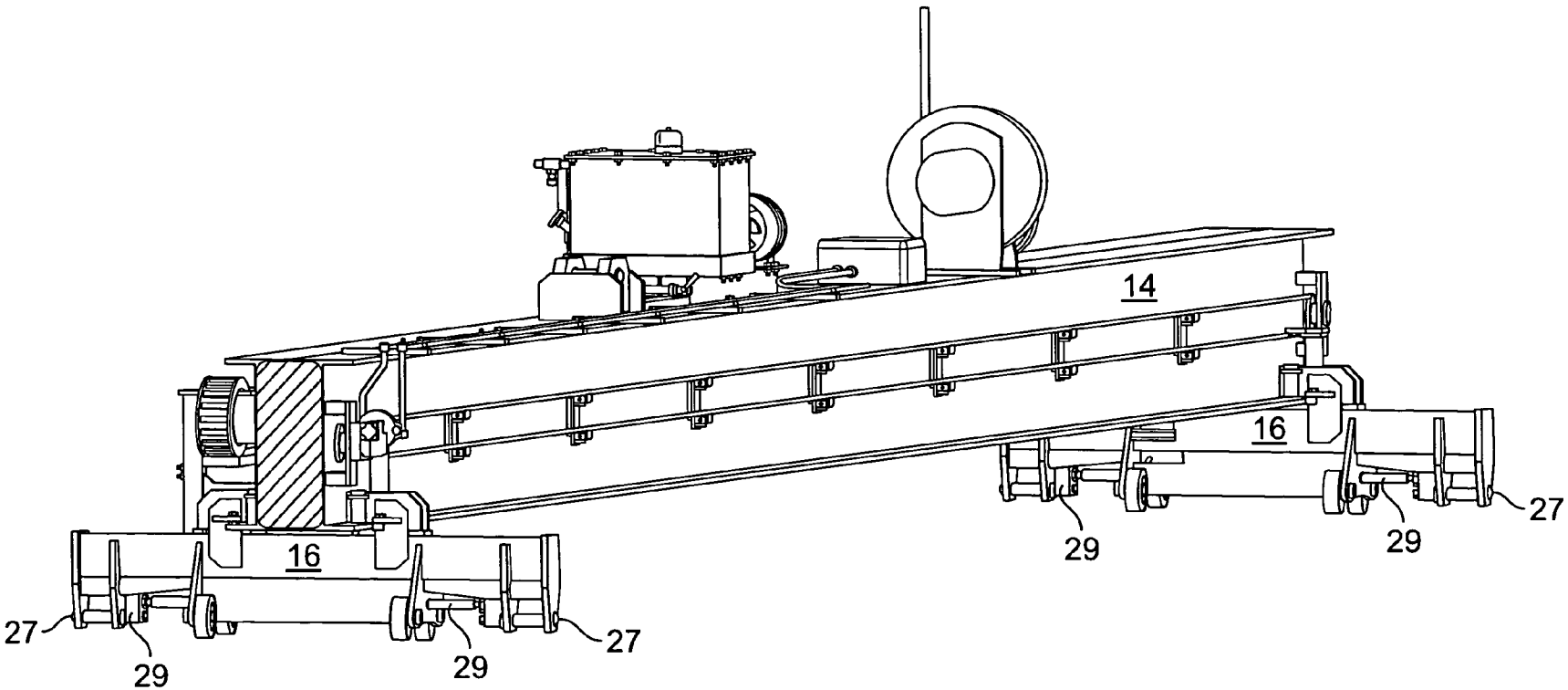
FIG. 14 is a perspective view of the automatic adjustable spreader bar showing electrical actuators on each cross member to control the load pick devices.
Figure 15:
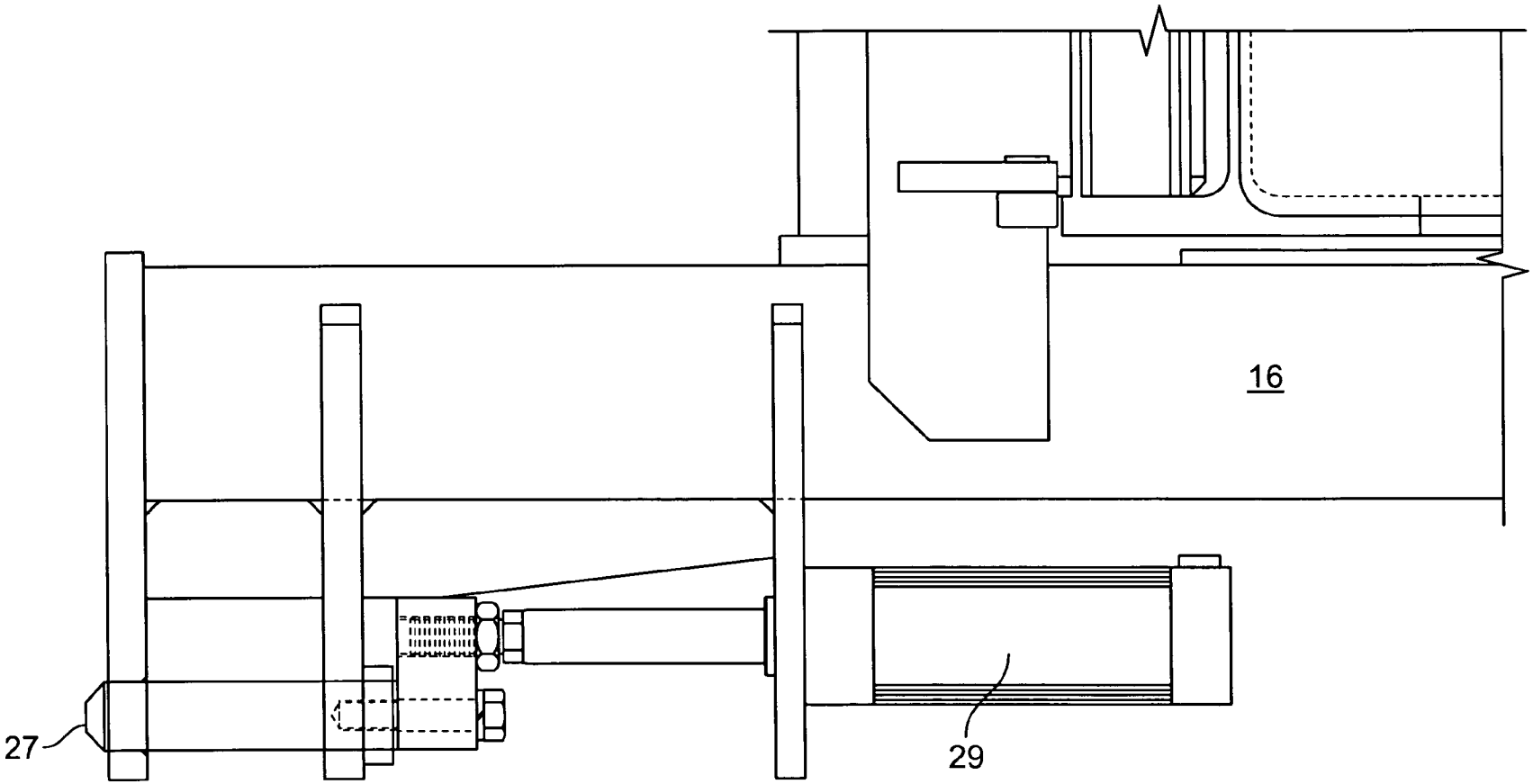
FIG. 15 is a perspective view of an electric actuator used to control load pick devices in one embodiment of the invention.

In an embodiment, as shown in FIGS. 7 and 8A, each one of the two load pick devices 26 is connected to a hydraulic actuator 25, which functions as the load-pick latching mechanism 24. Motion of the pick-point assemblies and the latching devices attached to the pick point assemblies may also be accomplished by other means such as electric actuators 29, as shown in FIGS. 14 and 15, without departing from the scope and intent of the invention.

Figure 5A:
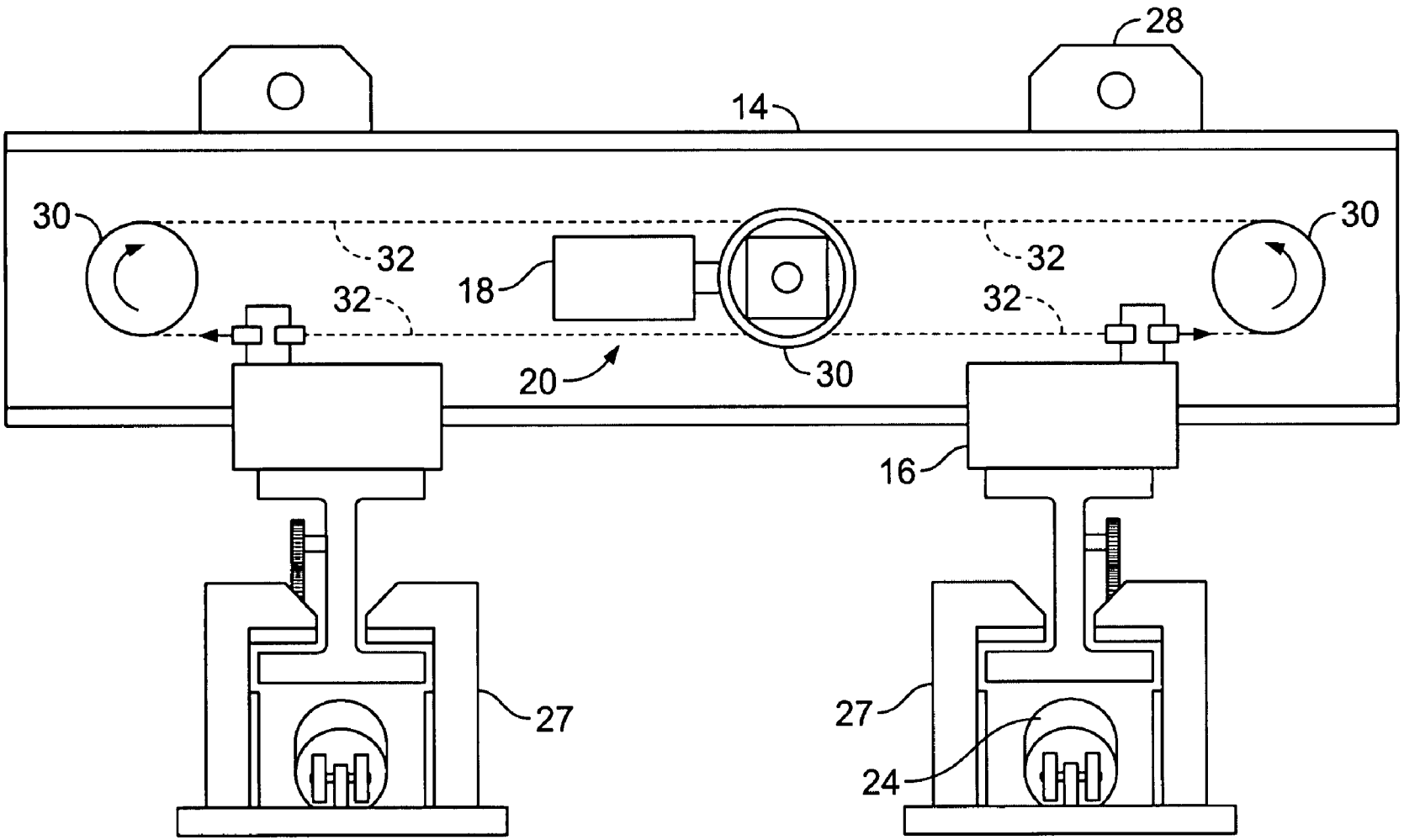
FIG. 5*a* is a schematic view showing the main spreader beam with a power source for moving two cross members lengthwise along the main beam.
Figure 6:
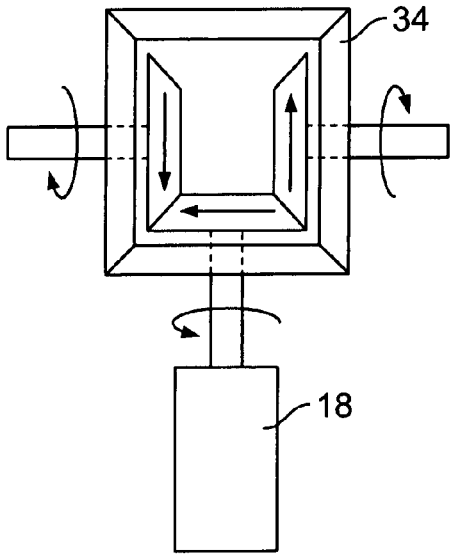
FIG. 6 is a schematic view of a power source used with the inventive device.

The spreader bar 14 is connected to a lifting vehicle (not shown), such as a crane, in any manner well known in the art. As shown in FIG. 5*a*, the spreader bar 14 may be attached to the crane by lift points 28 that can engage the crane hooks. The spreader bar 14 is equipped with at least two cross members 16 that are mechanically moveable along the length of the spreader bar 14. In an embodiment, as shown in FIGS. 4 and 5, the cross members 16 are moved using a motor 18, sprockets 30, and chain system 32. Other mechanical, hydraulic, or electric means, however, may be employed within the scope and context of this invention. A gear box 34, may also be employed with the drive mechanism 20, as shown in FIGS. 5 and 6.

Figure 13:
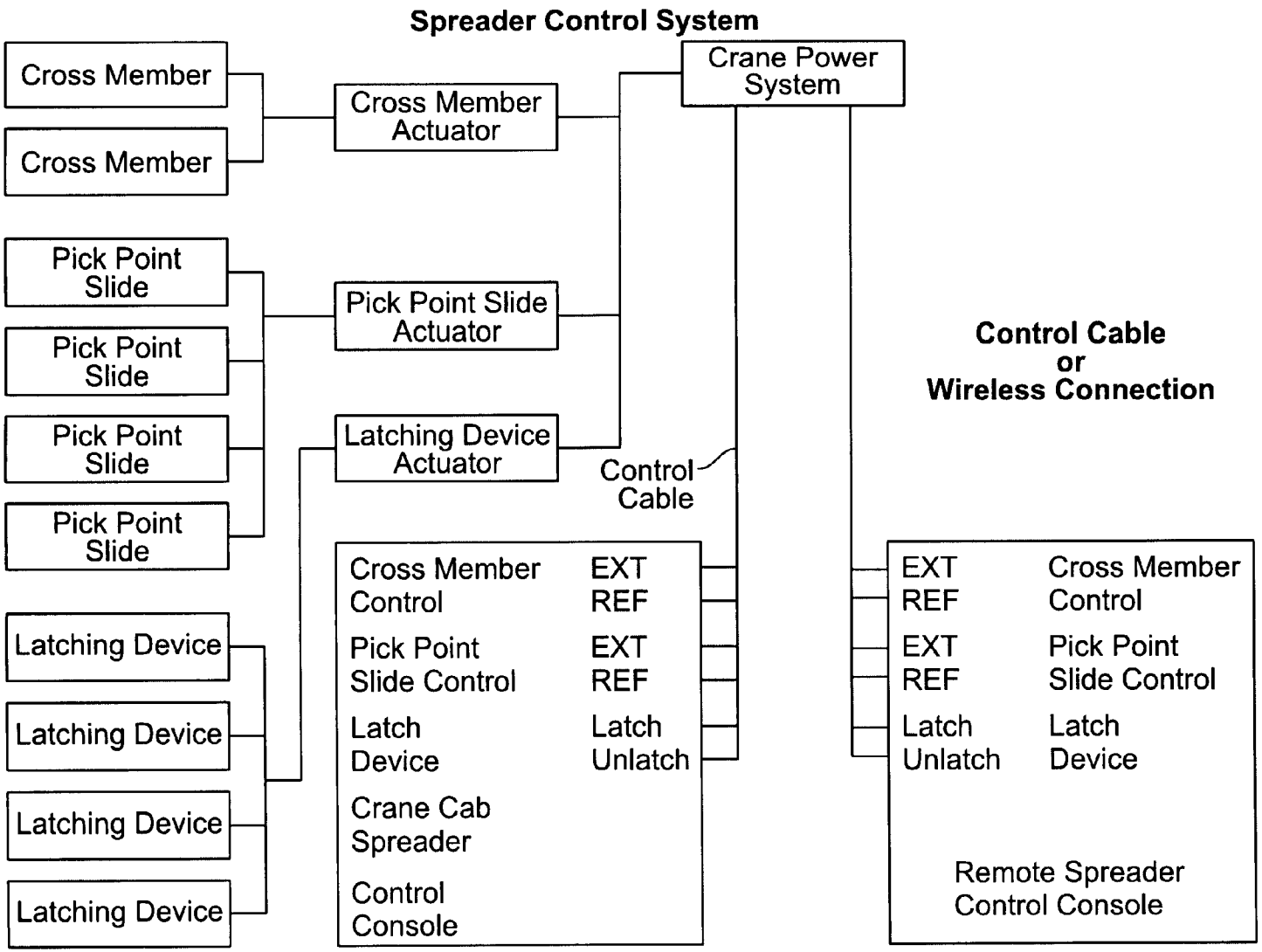
FIG. 13 is a block diagram of the control system of the inventive device.

The movement of the cross members 16 may be controlled in unison or individually by a crane operator within the cab of the crane through the use of an individual drive system. As shown in FIG. 13, a crane power system is electrically connected to an operating panel from which the cross members 16 and the pick points 27 may be controlled. This connection may be either a wired or wireless connection.

When in operation, an operator in or remote from the cab of the lifting vehicle actuates the movement of the cross members 16 by positioning a switch on the operating panel so as to extend or retract a particular cross member 16. Movement of this switch sends a signal that activates the cross member actuator or drive mechanism 20 which results in the cross member 16 being repositioned along the length of the spreader bar 14. Once the cross members 16 are in position, the operator positions another switch sending a signal that activates the respective pick point's actuator. This allows the pick point 27 to slide along the length of the cross member 16 until the point is positioned in the correct location. After the pick point 27 is correctly positioned along the cross member 16, the operator activates another switch on the control panel, thereby actuating the latching device 26 to engage the lifting means on the object 12 to be lifted. When all lifting means are properly engaged the crane operator can lift the object 12 in any manner known in the art. After lifting and placing the object 12 in the desired location the operator may activate the proper switch on the control panel to disengage the latch device from the lifting means.

The lifting device of the instant invention can be used with large heavy objects such as precast pieces of concrete, structural I-beams, or any other like objects. As mentioned above, control of the cross members 16 and load pick points 27 and latching device 26 can be accomplished by an operator within the cab of the lifting vehicle or by someone on the ground outside of the vehicle.

Each cross member has at least two moveable load pick points 27. The load pick points 27 are moveable in a lateral direction perpendicular to the length of the main spreader beam 14. The moving means in this case is a motor, sprocket, and chain system. However, other mechanical, hydraulic, or electric means may be employed within the scope and context of this invention.

The moveable load pick points 27 may be equipped with a variety of lifting devices to engage the object 12 to be lifted. FIG. 9(*a*) and (*b*) shows an example of one such device, a self-locking hook that is used to engage a loop-type lifting connection on an object 12, while FIGS. 10-12 show a twist-lock type of device for engaging an insert in an object 12 to be lifted.

The foregoing discussion shows a system that can accommodate a wide variety of product lift points and lift point positions by controllable means which eliminates the necessity of having personnel making manual connections to the products to be lifted and also eliminates the necessity of having personnel climb on stacks of stored products to make connections.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A device for lifting oversized pieces of material, the device comprised of:

a spreader bar capable of attaching to a hoisting system of a lifting vehicle;

at least two cross members attached to the spreader bar;

at least one cross-member power source attached to the spreader bar, the at least one cross-member power source connected to at least one drive mechanism;

the at least one drive mechanism connected to at least one of the at least two cross members;

a load-pick power source attached to each of the at least two cross members, the load-pick power source connected to at least one load-pick drive mechanism, the at least one load-pick drive mechanism connected to at least two load pick latching mechanisms which power two load pick points wherein the at least two load pick latching mechanisms are positioned by the load-pick drive mechanism along a length of the cross member so as to vary a distance between the load pick points, thereby allowing the load pick points to engage with a lifting connection on an object to be lifted; and the cross-member power source and the load-pick power source each electrically connected to an operating panel in a cab of the lifting vehicle.

2. The device of claim 1, wherein the cross-member power source and the load-pick power source are electric motors.

3. The device of claim 1, wherein the cross-member power source and the load-pick power source are hydraulic motors.

4. The device of claim 1, wherein the at least one drive mechanism connected to at least one of the at least two cross members is a chain.

5. The device of claim 1, wherein the at least one load-pick drive mechanism is a hydraulic cylinder.

6. The device of claim 1, wherein the cross-member power source and load-pick power source are each electrically connected to an operating panel remote from the lifting device.

7. The device of claim 1, wherein:

the cross-member power source is connected to a first and a second drive mechanism;

each of the first and second drive mechanisms are connected to a first and a second cross-member, respectively;

a first and a second load-pick power source connected to each of the first and second cross-member, respectively;

the first and second load-pick power sources connected to a first and a second load-pick drive mechanism, respectively; and the first and second load-pick drive mechanisms connected to a first and second load pick point, respectively.

8. The device of claim 1, wherein:

each one of the at least two load pick points is connected to a hydraulic actuator;

each of the hydraulic actuators is connected to the at least one load-pick drive mechanism.

9. The device of claim 1, wherein the drive mechanism is an electric actuator.

10. The device of claim 9, wherein the electric actuator is an electric linear actuator.

11. The device of claim 1, wherein each of the at least two load ipick points includes a load-engaging member.

12. The device of claim 11, wherein the load-engaging member a self-locking hook device.

13. The device of claim 11, wherein the load-engaging member is a twist-lock type device.

* * * * *